US010303093B2

(12) United States Patent
Tamaki et al.

(10) Patent No.: US 10,303,093 B2
(45) Date of Patent: May 28, 2019

(54) IMAGE FORMING APPARATUS THAT PROMPTS EXCHANGE OF A FIRST ROTATABLE MEMBER OF A FIXING PORTION BASED ON A ROTATION TIME OF THE FIRST ROTATABLE MEMBER OR A RECORDING MATERIAL LENGTH

(71) Applicant: CANON KABUSHIKI KAISHA, Tokyo (JP)

(72) Inventors: Masayuki Tamaki, Abiko (JP); Toshinori Nakayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 71 days.

(21) Appl. No.: 15/251,427

(22) Filed: Aug. 30, 2016

(65) Prior Publication Data

US 2017/0060051 A1 Mar. 2, 2017

(30) Foreign Application Priority Data

Aug. 31, 2015 (JP) ..... 2015-170392
Aug. 31, 2015 (JP) ..... 2015-170393

(51) Int. Cl.
*G03G 15/20* (2006.01)
*G03G 15/00* (2006.01)

(52) U.S. Cl.
CPC ..... *G03G 15/2039* (2013.01); *G03G 15/553* (2013.01); *G03G 15/2042* (2013.01); *G03G 2215/2035* (2013.01)

(58) Field of Classification Search
CPC ..... G03G 15/2039
USPC ..... 399/33
See application file for complete search history.

(56) References Cited

U.S. PATENT DOCUMENTS

2003/0123077 A1* 7/2003 Siegel ..... G03G 15/553 358/1.14
2006/0024072 A1* 2/2006 Kuroki ..... G03G 15/2064 399/33
2014/0376940 A1* 12/2014 Wagatsuma ..... G03G 15/205 399/70
2015/0234334 A1* 8/2015 Yoda ..... G03G 15/5004 399/33

FOREIGN PATENT DOCUMENTS

JP 2008-083091 A 4/2008

* cited by examiner

*Primary Examiner* — Walter L Lindsay, Jr.
*Assistant Examiner* — Philipmarcus T Fadul
(74) *Attorney, Agent, or Firm* — Venable LLP

(57) ABSTRACT

An image forming apparatus has an image forming portion, and a fixing portion including a first rotatable member and a second rotatable member that form a nip, and a detecting portion configured to detect a temperature of the first rotatable member. An acquiring portion acquires a rotation time of the first rotatable member, and a notifying portion provides a notification prompting exchange of the first rotatable member on the basis of an accumulated value of the rotation time of the first rotatable member acquired by the acquiring portion, the rotation time being subjected to weighting on the basis of the temperature of the first rotatable member detected by the detecting portion.

6 Claims, 7 Drawing Sheets

IMAGE FORMING APPARATUS THAT PROMPTS EXCHANGE OF A FIRST ROTATABLE MEMBER OF A FIXING PORTION BASED ON A ROTATION TIME OF THE FIRST ROTATABLE MEMBER OR A RECORDING MATERIAL LENGTH

CLAIM OF PRIORITY

This application claims the benefit of Japanese Patent Applications No. 2015-170392, filed on Aug. 31, 2015, and No. 2015-170393, filed on Aug. 31, 2015, both of which are hereby incorporated by reference herein in their entireties.

FIELD OF THE INVENTION AND RELATED ART

The present invention relates to a calculating device for calculating a lifetime of a rotatable member for heating a toner image on a recording material, and relates to an image forming apparatus. As the image forming apparatus, for example, it is possible to use one of a copying machine, a printer, a facsimile machine, and a multi-function machine having a plurality of functions of these machines.

In the image forming apparatus employing an electrophotographic process, the toner image is formed on the recording material and is heated and pressed by a fixing device, so that the toner image is fixed on the recording material.

Japanese Laid-Open Patent Application No. (JP-A) 2008-83091 discloses a fixing device employing a constitution in which an endless belt is rotated by a heating roller. Further, an inner surface of the endless belt slides with a pressure-imparting member. Therefore, a lubricant is applied onto the inner surface of the endless belt, so that a sliding load between the endless belt and the pressure-imparting member is reduced.

In a case in which such a fixing device is continuously used, however, the above-described lubricant becomes depleted, or the like, and thus, a state of an inner peripheral surface of the endless belt changes, so that the sliding load between the endless belt and the pressure-imparting member gradually increases.

When a sliding resistance between the endless belt and the pressure-imparting member is large, the endless belt does not rotate properly, so that there is a liability that the recording material cannot be properly nipped and fed, and thus, generation of an image defect is invited.

Therefore, in the fixing device disclosed in JP-A 2008-83091, a constitution in which a warning is given in a case in which an increase in sliding load progresses.

In a case in which a load detecting mechanism for detecting the sliding load of the endless belt is newly mounted, however, it leads to an increase in cost. For that reason, when a lifetime of the belt is notified or exchange of the belt is prompted, it has been required that the notification and the prompting are realized without providing a special mechanism.

SUMMARY OF THE INVENTION

According to one aspect, the present invention provides a calculating device for calculating a lifetime of a rotatable member for heating a toner image, formed on a recording material, at a nip, the calculating device comprising a first acquiring portion configured to acquire a rotation time of the rotatable member, an accumulating portion configured to accumulate the rotation time of the rotatable member acquired by the first acquiring portion, and a second acquiring portion configured to acquire a temperature of the rotatable member, wherein the accumulating portion accumulates the rotation time of the rotatable member acquired by the first acquiring portion after weighting is made on the basis of the temperature of the rotatable member acquired by the second acquiring portion.

Further features of the present invention will become apparent from the following description of exemplary embodiments with reference to the attached drawings.

DESCRIPTION OF THE EMBODIMENTS

Embodiments of the present invention will be described specifically with reference to the drawings.

First Embodiment

Image Forming Apparatus

Figure 1:
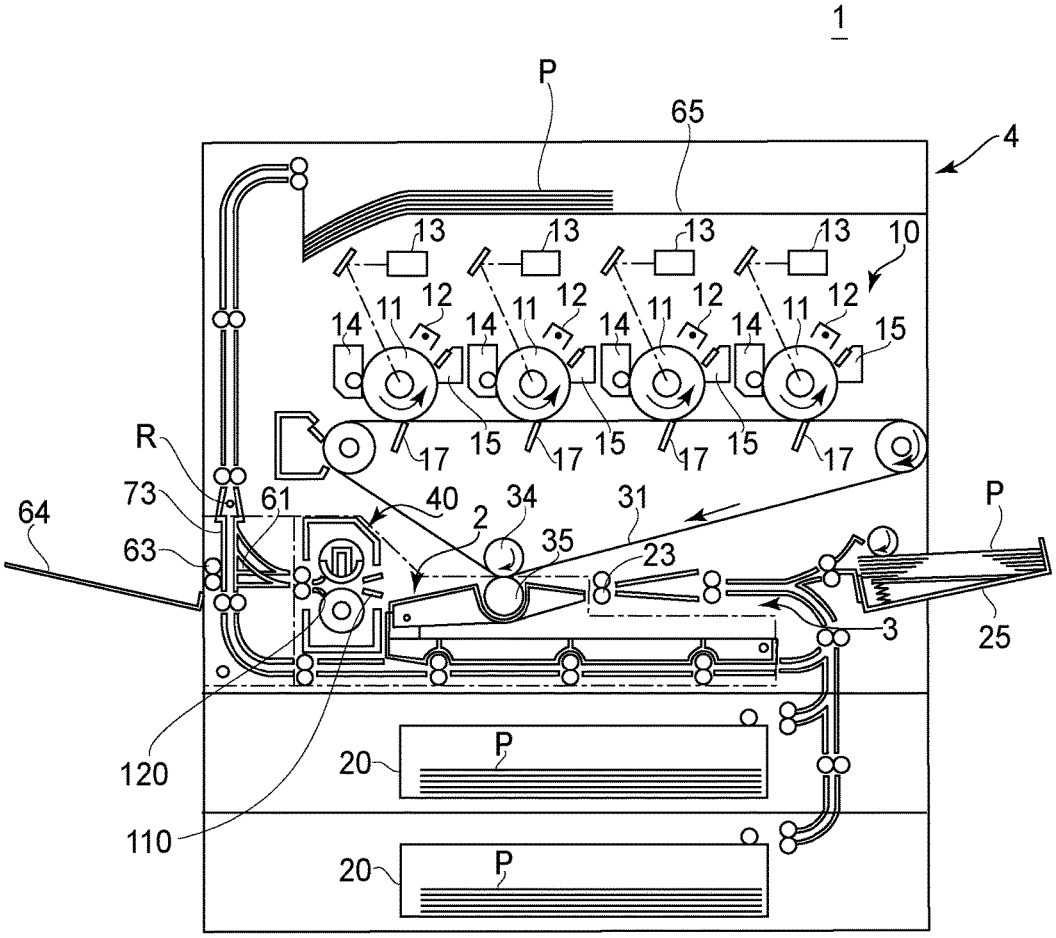
FIG. 1 is a schematic view of an image forming apparatus in which a fixing device is mounted.

FIG. 1 is a sectional view of a color electrophotographic printer as an example of an image forming apparatus 1 according to the present invention in which a fixing device 40 is mounted, and is the sectional view of the image forming apparatus 1 along a sheet feeding direction. Generally, the image forming apparatus 1 includes an image forming portion 10 for forming a toner image on a recording material (or a sheet P), and an image heating portion (fixing device) for heating the toner image formed on the recording material.

The printer 1 shown in FIG. 1 includes an image forming portion 10 for forming images of yellow (Y), magenta (M), cyan (C), and black (Bk). Each of photosensitive drums 11 is electrically charged in advance by a charging device 12. Thereafter, a latent image is formed on the photosensitive drum 11 by a laser scanner 13. The latent image is developed into a toner image by a developing device 14. Toner images on the photosensitive drums 11 are successively transferred onto, e.g., an intermediary transfer belt 31, which is an image bearing member, by a primary transfer blade 17. After the transfer, a temperature remaining on the photosensitive drum 11 is removed by a cleaner 15. As a result, a surface of the photosensitive drum 11 is cleaned, and then prepares for subsequent image formation.

On the other hand, a sheet P, as a recording material, is sent one by one from a sheet feeding cassette 20 or a multi-sheet feeding tray 25, and is fed into a registration roller pair 23. The registration roller pair 23 receives the sheet P, and, in a case in which the sheet P moves obliquely, the registration roller pair 23 straightens the sheet P. Then, the registration roller pair 23 sends the sheet P to a position between the intermediary transfer belt 31 and a secondary transfer roller 35 in synchronism with the toner image being formed on the intermediary transfer belt 31.

The color toner image on the intermediary transfer belt 31 is transferred onto the sheet P by, e.g., the secondary transfer roller 35, which is a transfer member. Thereafter, the sheet P is heated and pressed by the fixing device 40 (FIG. 2), including a heating unit in an inner surface side of a fixing film 41, so that the toner image is fixed on the sheet P.

Fixing Device

Figure 2:
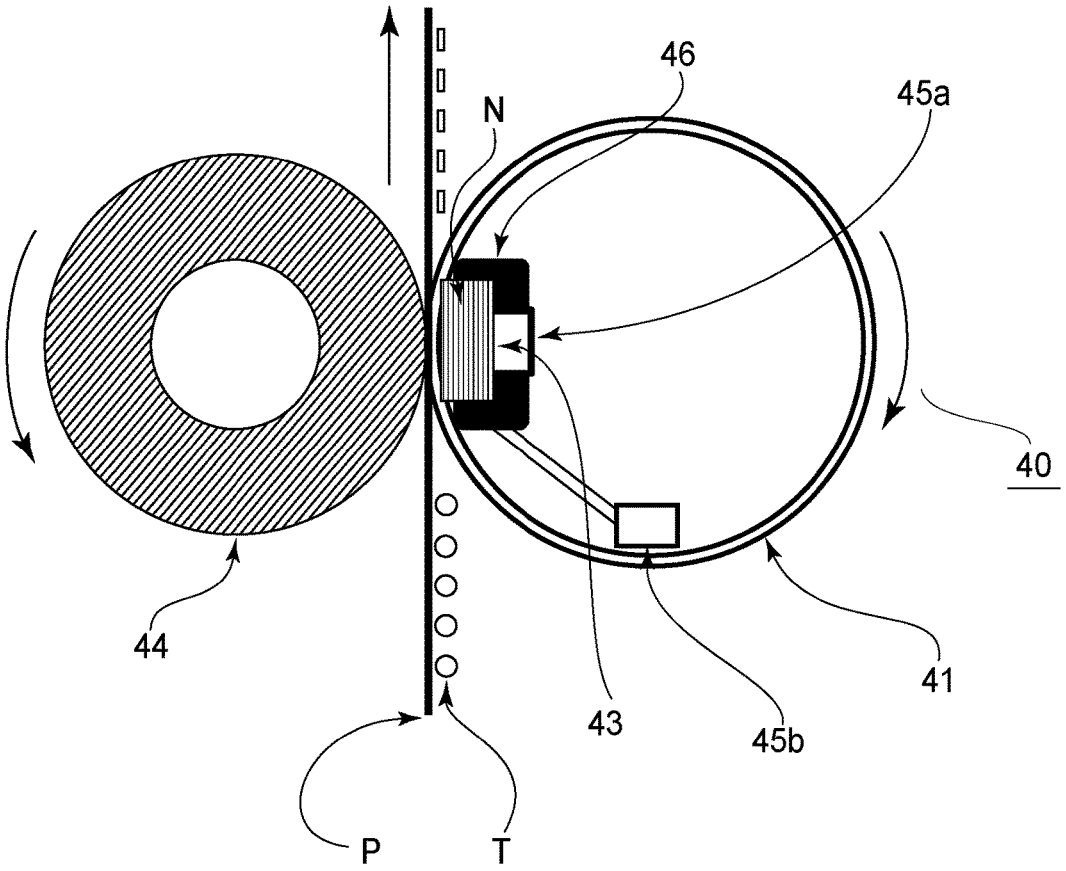
FIG. 2 is a schematic view of a fixing device.

Next, the fixing device 40 in this embodiment will be described. As shown in FIG. 2, in this embodiment, the fixing device 40 of a film heating type (tension-less type) was used. The sheet P, which is the recording material on which the toner image is formed at the image forming portion, is nipped and fed through a nip (fixing nip) N formed by a fixing film 41 provided exchangeably by a rotatable endless belt, and a pressing roller 44, which is a rotatable driving member, so that the toner image is fixed on the sheet P.

A ceramic heater 43 is provided as a heating member for heating the image on the recording material. The heater 43 has a basic structure including a ceramic substrate having an elongated thin plate shape extending in a longitudinal direction crossing a recording material feeding direction (i.e., a direction perpendicular to the drawing sheet P of FIG. 2), and an energization heat generating resistor layer formed on a surface of the substrate. The heater 43 is a low thermal capacity heater that increases in temperature with an abrupt rising characteristic as a whole by energization to the heat generating resistor layer. Further, a constitution in which an energization region is switched depending on a longitudinal width size of the sheet P as the recording material is employed.

Figure 3:
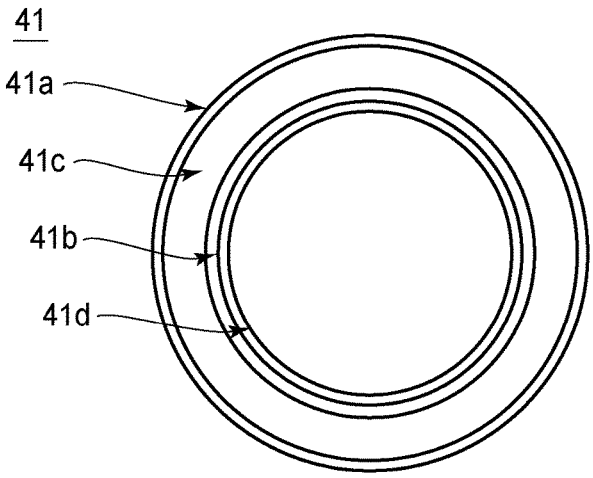
FIG. 3 is a schematic view of a fixing film.

The fixing film 41 is a cylindrical (endless) rotatable member as a heating member for conducting heat, and is a film having a heat-resistant property. The fixing film 41 is external fitted loosely around an external surface of a supporting member including the heater 43. The fixing film 41 in this embodiment has, as shown in FIG. 3, a four-layer composite structure including a surface layer 41*a*, an elastic layer 41*c*, a base material metal layer (base layer) 41*b*, and an inner surface layer 41*d* from a surface side.

As the surface layer 41*a*, a layer formed of a fluorine-containing resin material in a thickness of 100 μm or less, preferably, 10 μm to 70 μm. As the fluorine-containing resin material, for example, polytetrafluoroethylene (PTFE), fluorinated ethylene propylene (FEP), perfluoroalkoxy alkane (PFA), or the like, can be used. In this embodiment, a PFA tube was used.

As the base material metal layer 41, in order to improve a quick start property, a layer formed of a heat-resistant material, e.g., a film of metal, such as stainless steel (SUS) or nickel, in a thickness of 100 μm or less, preferably, 50 μm or less, and 20 μm or more, is used. In this embodiment, a cylindrical nickel (metal) film of 30 μm in thickness and 25 mm in diameter was used.

The elastic layer 41*c* is sandwiched between the surface layer 41*a* and the base layer 41*b*. Further, in order to improve the quick start property by decreasing a thermal capacity, a filler for enhancing a heat conducting property was added. In this embodiment, a 200 μm-thick silicone rubber of 10 degrees in rubber hardness (Japan Industrial Standard (JIS-A)) and 1.3 W/m·K in thermal conductivity was used.

As the inner surface layer 41*d*, a layer formed of a resin material, such as a polyimide resin material, having a high durability and a high heat-resistant property is suitable. In this embodiment, a polyimide precursor solution obtained by reaction between aromatic diamine and aromatic tetracarboxylic dianhydride or its derivative, which are mixed in a substantially equal molar ratio in an organic polar solvent, was used. This solution is coated on an inner surface of the base material metal layer 41*b*, followed by drying, heating, and dewatering (dehydration) ring-closing reaction to form a polyimide resin layer. The thus-formed polyimide resin layer was used as the inner surface layer 41*d*.

Specifically, in this embodiment, as the polyimide precursor solution, a solution of a polyimide precursor consisting of 3,3',4,4'-biphenyltetracarboxylic dianhydride and para-phenylene diamine in N-methyl-2-pyrrolidone was used. Then, a 15 μm-thick polyimide resin layer was formed and was used as the inner surface layer 41*d*.

The pressing roller 44 is a heat-resistant elastic roller as a pressing member and is constituted by a metal core and an elastic layer formed with a heat-resistant rubber, such as silicone rubber or fluorine-containing rubber, or with a foam member of the silicone rubber, and is provided by being rotatably shaft-supported at both end portions of the metal core. In a side on the pressing roller 44, the fixing film 41 and the heater 43 are disposed in parallel to the pressing roller 44 in the heater 43 side, and are urged by an unshown urging member. As a result, a lower surface of the fixing film 41 is press-contacted from the heater 43 side to an upper surface of the pressing roller 44 against elasticity of the elastic layer of the pressing roller 44, so that a fixing nip N as a heating portion is formed in a predetermined width.

The pressing roller 44 is rotationally driven in an arrow direction (counterclockwise direction) in FIG. 2 at a predetermined rotational peripheral speed by a driving motor M, which is a stepping motor, and a transmitting portion G, such as a gear, after the driving motor M receives a rotation instruction from a control circuit. By this rotation drive of the pressing roller 44, a press-contact frictional force generates in the fixing nip N between the pressing roller 44 and the fixing film 41, so that a rotational force acts on the cylindrical fixing film 41. Then, the fixing film 41 is in a following rotation state in an arrow direction (clockwise direction) in FIG. 2 while being slid with a downward surface of the heater 43 in close contact with the downward surface of the heater 43. Here, a supporting member for supporting the fixing film 41 also functions as a rotation guide member for the cylindrical fixing film 41.

Thus, the pressing roller 44 is rotationally driven, and with the rotational drive, the cylindrical fixing film 41 is in the following rotation state. Then, in a state in which energization to the heater 43 is made and the heater 43 quickly increases in temperature to a predetermined temperature and then is temperature-controlled, the sheet P, on which an unfixed toner image T is formed, is introduced into the nip N between the fixing film 41 and the pressing roller 44. Then, a toner image carrying surface of the sheet P closely contacts an outer surface of the fixing film 41, and the sheet P is nipped and fed together with the fixing film 41 through the nip N.

In this nip-feeding process, the sheet P is heated by heat of the fixing film 41 heated by the heater 43, so that the unfixed toner image T on the sheet P is heated and pressed, and thus, is melt-fixed on the sheet P. Then, the sheet P, which passed through the nip N, is curvature-separated from the surface of the fixing film 41 and is then fed and discharged.

Figure 4:
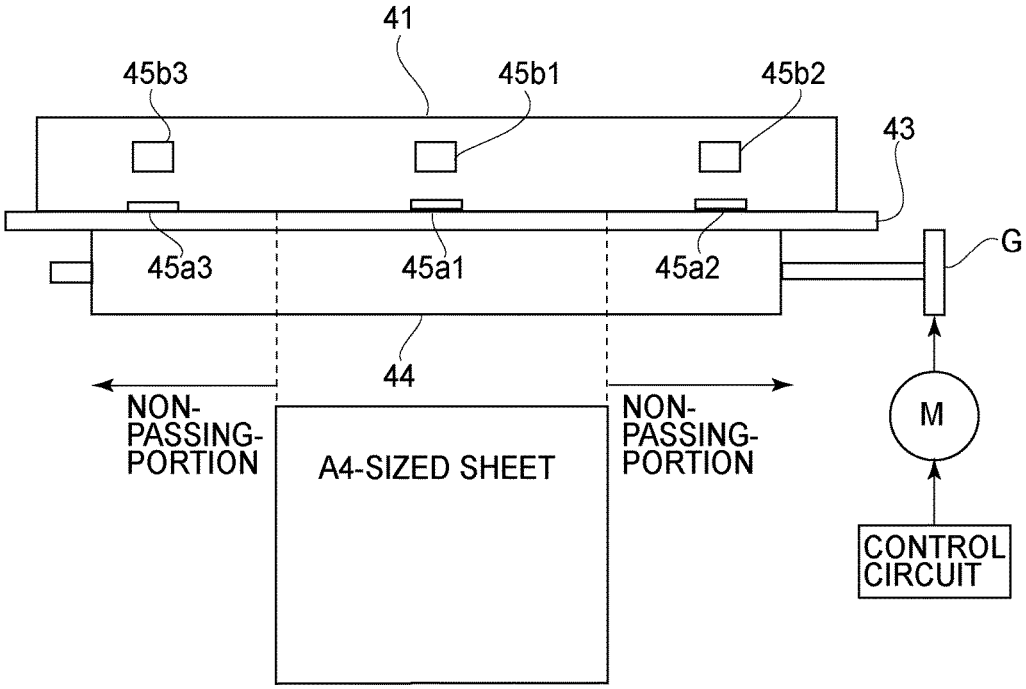
FIG. 4 is a schematic view for illustrating an example of arrangement of toner detecting portions.

In FIG. 2, contact thermometers (thermistors) 45*a* measure temperatures of a back surface of the heater 43. Further, as shown in FIG. 4, the heater back surface thermistors 45*a* includes a central portion thermistor 45*a*1 and end portion thermistors 45*a*2 and 45*a*3 with respect to an operation direction. The central portion thermistor 45*a*1 is disposed at a longitudinal central portion, and the end portion thermistors 45*a*2 and 45*a*3 are disposed at positions of ±150 mm from a longitudinal center of the heater 43.

Further, contact thermistors (thermistors) 45*b* measure temperatures of an inner surface (i.e., an inner peripheral surface, or a back surface) of the fixing film 41 heated by the heater 43. Further, as shown in FIG. 4, the film back surface thermistors 45*b* include a central portion thermistor 45*b*1 and end portion thermistors 45*b*2 and 45*b*3 with respect to a longitudinal direction of the fixing film 41.

The central portion thermistor 45*b*1 of the film back surface thermistors 45 is a detecting portion for detecting the temperature of the fixing film 41 in a first region where a recording material has a predetermined width narrower than a width of a maximum width-sized recording material capable of being introduced into the fixing device 40 with respect to the longitudinal direction of the fixing film 41. Further, each of the end portion thermistors 45*b*2 and 45*b*3 is a detecting portion for detecting the temperature of the fixing film 41 in one end side in a second region outside of the first region with respect to the longitudinal direction of the fixing film 41.

The central portion thermistor 45*b*1 is disposed at the longitudinal central portion, and the end portion thermistors 45*b*2 and 45*b*3 are disposed at positions of ±150 mm from a longitudinal center of the fixing film 41. Further, temperature detection results of these thermistors are sent to an unshown controller. Incidentally, positions of these thermistors 45 may also be changed as desired.

In FIG. 2, a heater holder 46 is a member for holding the heater 43 generating heat to a high temperature, and also functions as an urging member, provided in a side where there is no fixing film 41, for urging the fixing film 41 toward the pressing roller 44. In this embodiment, diameters of the fixing film 41 and the pressing roller 44 are set at 30 mm. Further, the fixing film 41 and the pressing roller 44 are contacted to each other at a total pressure of 30 kgf, so that a width of the nip N (with respect to the feeding direction of the sheet P) is about 8 mm. Here, a process speed of the image forming apparatus 1 is 250 mm/s, and productivity of A4-sized plain paper is 60 ppm for both of monochromatic image formation and color image formation.

In the fixing device in this embodiment, supplied electrical power to the heater 43 is adjusted so that a temperature of the central portion film back surface thermistor 45*b*1 is 170° C. Further, the temperature of the central portion film back surface thermistor 45*b*1 is changed depending on an environment in which the image forming apparatus 1 is placed and a species of the paper (recording material) subjected to sheet passing.

When plain paper 1 (paper that weighs 81 grams or less) is passed through the fixing device 40 in an environment of 23° C. in which the image forming apparatus 1 is placed, a setting is made so that the temperature of the central portion film back surface thermistor 45*b*1 is 170° C. Further, when plain paper 2 (paper that weighs 105 grams or less) is passed through the fixing device 40 in the environment of 23° C. in which the image forming apparatus 1 is placed, a setting is made so that the temperature of the central portion film back surface thermistor 45*b*1 is 180° C.

When the plain paper 1 (paper that weighs 81 grams or less) is passed through the fixing device 40 in an environment of 15° C. in which the image forming apparatus 1 is placed, a setting is made so that the temperature of the central portion film back surface thermistor 45*b*1 is 180° C. Further, when the plain paper 2 (paper that weighs 105 grams or less) is passed through the fixing device 40 in the environment of 15° C. in which the image forming apparatus 1 is placed, a setting is made so that the temperature of the central portion film back surface thermistor 45*b*1 is 190° C.

When the plain paper 1 (paper that weighs 81 grams or less) is passed through the fixing device 40 in an environment of 30° C. in which the image forming apparatus 1 is placed, a setting is made so that the temperature of the central portion film back surface thermistor 45*b*1 is 160° C. Further, when the plain paper 2 (paper that weighs 105 grams or less) is passed through the fixing device 40 in the environment of 30° C. in which the image forming apparatus 1 is placed, a setting is made so that the temperature of the central portion film back surface thermistor 45*b*1 is 170° C.

In this embodiment, in order to reduce the sliding resistance between the fixing film inner surface and the heater 43, grease is applied onto a sliding surface of the heater 43. As the grease, 1.0 g of grease ("MOLYKOTE HP-300", manufactured by Dow Corning Toray Co., Ltd.) is applied onto the heater surface.

Estimation of Fixing Device Lifetime LIFE 1 from Viewpoint of Fixing Film Inner Surface Abrasion When the sliding resistance between the fixing film inner surface and the heater 43 becomes high, the rotation drive of the pressing roller 44 is not satisfactorily transmitted to the fixing film 41, and the fixing film 41 slips, so that a failure such that the paper cannot be fed can occur. As a cause of an increase in sliding resistance between the fixing film inner surface and the heater 43, it is possible to cite a long rotation distance (travelling distance) of the fixing film 41 and a high temperature of the heater 43 (and, therefore, the fixing film 41).

There are two causes of the increase in sliding resistance by the rotation distance (travelling distance) of the fixing film 41. First is such that the fixing film inner surface rotates while sliding with the heater 43, and is abraded to generate abraded powder, and thus, the abraded powder provides a rotational resistance. Second is such that the grease for reducing the sliding resistance leaks out from an end portion of the fixing film 41 by rotation of the fixing film 41, and thus, an amount of the grease between the fixing film inner surface and the heater 43 lowers.

Further, with a higher temperature of the heater 43 (and the fixing film 41), a hardness of the fixing film 41 inner surface lowers, and abraded powder is liable to generate, so that durability (rotation distance) deterioration is accelerated, and thus, the sliding resistance between the fixing film inner surface and the heater 43 increases.

Further, with the higher temperature of the heater 43 (and the fixing film 41), the grease volatilizes, so that the sliding resistance between the fixing film inner surface and the heater 43 increases. Therefore, depending on the temperature of the heater 43 (and the fixing film 41), a lifetime of the fixing device 40 changes.

Figure 5:
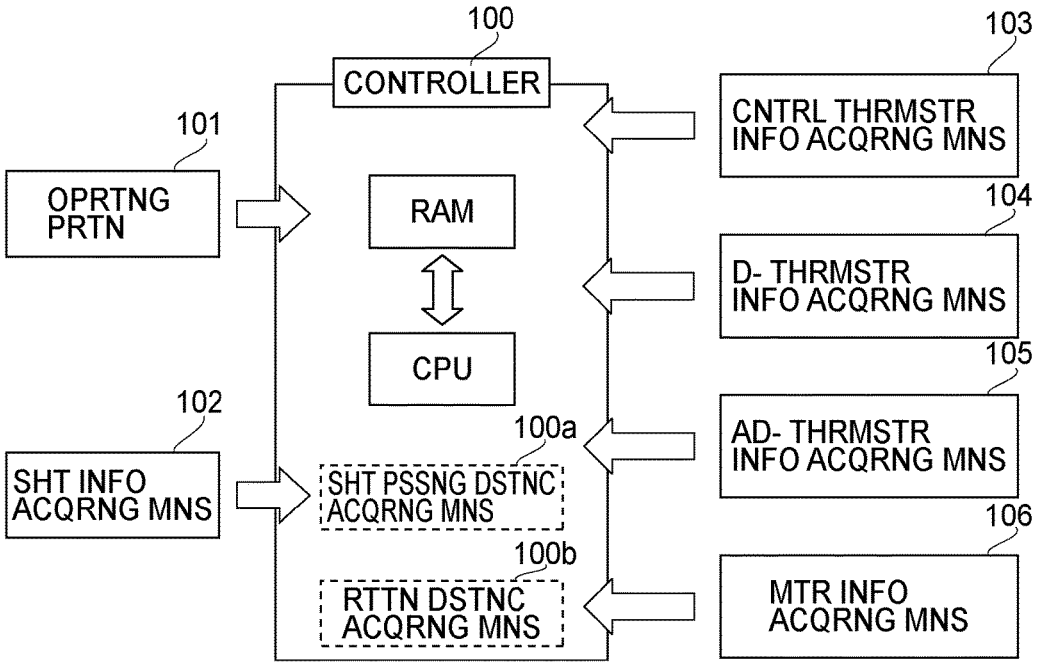
FIG. 5 is a block diagram showing a control system of the fixing device.

In this embodiment, every temperature zone of the heater 43 (and the fixing film 41), a cumulative rotation distance (traveling distance) of the fixing film 41 is measured and, on the basis of the measured cumulative rotation distance, a notification prompting exchange of the fixing film 41 is provided. That is, a first acquiring portion and a second acquiring portion (rotation distance acquiring portion 100*b* shown in FIG. 5), which are used for acquiring information on a cumulative rotation time when a detected temperature of the temperature detecting portion is in a first temperature range and in a second temperature range different from the first temperature range, are provided. Further, a notifying portion (a controller 100 and an operating portion as a display portion, which are shown in FIG. 5), for providing notification to the effect that the fixing film 41 should be exchanged, on the basis of the first acquiring portion and the second acquiring portion, is provided.

Further, in this embodiment, in every temperature zone of the heater 43 (and the fixing film 43), the cumulative rotation distance (travelling distance) of the fixing film is measured, so that a coefficient (third weighting coefficient) is set for every temperature zone of the heater 43 (and the fixing film 41). Then, when the sum (cumulative value) of a product of the fixing film rotation distance and the coefficient exceeds a certain (predetermined) value, a discrimination that the fixing device 40 reaches an end of a lifetime (device lifetime) LIFE 1 is made, so that the notification prompting exchange can be provided.

Sections of the temperature zones and the coefficients (weighting coefficients) of the fixing film in this embodiment are shown in Table 1.

TABLE 1

| | RD*2 (mm) | Coefficient | |
|---|---|---|---|
| CPT*1 (° C.) | | | |
| 190 ≤ T | L3 | a3 | 1.5 |
| 170 < T < 190 | L2 | a2 | 1.1 |
| T ≤ 170 | L1 | a1 | 1.0 |
| D-EPT*3 (° C.) | | | |
| 190 ≤ T | L6 | a6 | 1.5 |
| 170 < T < 190 | L5 | a5 | 1.1 |
| T ≤ 170 | L4 | a4 | 1.0 |
| AD-EPT*4 (° C.) | | | |
| 190 ≤ T | L9 | a9 | 1.5 |
| 170 < T < 190 | L8 | a8 | 1.1 |
| T ≤ 170 | L7 | a7 | 1.0 |

*1"CPT" is the central portion temperature of the fixing film back surface.
*2"RD" is the rotation distance.
*3"D-EPT" is a D (drive)-side end portion temperature of the fixing film back surface.
*4"AD-EPT" is an AD (anti-drive)-side end portion temperature of the fixing film back surface.

As shown in Table 1, the toner sections of the central portion of the fixing film back surface, the drive-side end portion of the fixing film back surface, and the anti-drive-side end portion of the fixing film back surface were as follows. That is, three sections where 170° C. or less as a first temperature range, more than 170° C. and less than 190° C. as a second temperature range, and 190° C. or more as the third temperature range. For every temperature section, an associated one of fixing film rotation distances L1 to L9 is measured. A unit of L1 to L9 is mm.

Measurement of the fixing film rotation distance is made by acquiring (calculating) a process speed (mm/s), which is a rotational speed of the fixing film 41, and a sampling time (0.1 s) as to a driving time of a driving motor. Specifically, the fixing film rotation distance is acquired (calculated) as a value obtained by multiplying the sampling time per pulse relating to the driving motor and the number of pulses by the process speed. Then, a signal value of each of the thermistors is sent to a control circuit, and a value of the rotation distance is stored in a rotation distance table prepared for each of the temperature zones.

There is no need to stick to the three temperature sections, and the number of the temperature sections may also be increased or decreased. By increasing the number of the temperature sections, accuracy of the indication of a lifetime is improved. The number of calculating regions of the image forming apparatus 1 in this embodiment increases, however, and, therefore, there is a need to take measures, such as an increase in the number of memories of the image forming apparatus 1.

The temperature sections were determined depending on the temperatures of the fixing film back surface, but may also be determined depending on temperatures of the heater back surface.

The lifetime LIFE 1 of the fixing device 40 is defined by the following formula:

$$LIFE1 = \left[ \mathrm{Max}\left( \sum_{i=1}^{3} Li \times ai \right)_j \Big/ A \right] \times 100$$

where "i" indicates a temperature section (three sections of 170° C. or less, more than 170° C. and less than 190° C., and 190° C. or more in this embodiment), "j" indicates a thermistor section (three sections of a central portion, a D-side end portion and an AD-side end portion), and "A" is a normalization constant ($1.0\times10^8$ mm in this embodiment).

The coefficient for each of the temperature zones is determined on the basis of the fixing film rotation distance in which slip of the fixing film 41 generates (weighting coefficient: 1) when a sheet passing durability test is conducted in a certain mode (in which the temperature of the film back surface thermistor is 170° C. in this embodiment). A random access memory (RAM) of the controller 100, which is a calculating device, is a storing portion (memory), and is capable of storing a value of the rotation distance for each of the temperature zones.

When the sheet passing durability test is conducted every temperature zone, the fixing film rotation distances in which the slip of the fixing film 41 generates are defined as follows:

170° C. durability: La (mm),
180° C. durability: Lb (mm), and
190° C. durability: Lc (mm).

La is 25M (mm), for example, and corresponds to 1666 (min) when converted into a rotation time of the fixing film 41 (i.e., a belt rotation time). Further, Lb is 20M (mm), for example, and corresponds to 1333 (min) when converted into the belt rotation time. Further, Lc is 15M (mm), for example, and corresponds to 1000 (min) when converted into the belt rotation time.

Here, the coefficients are based on the fixing film rotation distances at 170° C., and, therefore the coefficients when the durability test is conducted at 180° C. can be acquired (calculated) as La/Lb, which is greater than 1 when La>Lb. Further, the coefficients when the durability test is conducted at 190° C. can be acquired (calculated) as La/Lc.

The durability test for each temperature zone was conducted by increasing the control temperature of the fixing film back surface, and then passing A4-sized sheets ("GF-0081", manufactured by Canon, Inc.) through the fixing device 40. A discrimination of the slip generation was made by eye observation of the slip of the fixing film 41 for every predetermined number of sheets while passing A3-sized sheets ("CS-520", manufactured by Canon, Inc.) through the fixing device 40. The fixing film rotation distances in which the slip generated were $La=1.0\times10^8$ (mm), $Lb=8.1\times10^7$ (mm), and $Lc=6.7\times10^7$ (mm). From the above result, the coefficient for each of the temperature zones was set as shown in Table 1.

In this embodiment, as the coefficients for the central portion thermistor 45*b*1 and the end portion thermistors 45*b*2 and 45*b*3, the same value was set, but the values may also be changed between the central portion and the end portions. Further, at the end portions, a non-sheet passing portion temperature rise is liable to generate, and, therefore, the temperature section at the end portions may also be made higher than the temperature section at the central portion.

In a case in which the above-described value of LIFE 1 reaches 100%, it is possible to provide a notification to the effect that the fixing film, which is first rotatable member, should be exchanged, by a notifying portion. A central processing unit (CPU) 100 functions as the notifying portion and sends a signal to the operating portion 101 of an image forming apparatus main assembly. The operating portion 101 is a touch panel, and a display thereof functions as the notifying portion (display portion). In this manner, lifetime advance notice of the fixing device 40 is made.

Incidentally, a determining portion capable of determining whether or not notification to the operation portion 101 is provided may also be provided.

Block Circuit and Control Flow

A block circuit in this embodiment is shown in FIG. 5. FIG. 5 shows a control system of the image forming apparatus 1 including the fixing device 40 in this embodiment. Control of an entirety of the image forming apparatus 1 is effected by the controller 100 with which the operating portion 101 constituted by a liquid crystal touch panel and buttons, and the like, is connected. By input of various conditions from the operating portion 101 by an operator (user), the image forming apparatus 1 starts an operation.

Information, such as a size and a basis weight of the recording material (sheet) to be passed though the fixing device 40, is sent from a sheet information acquiring portion 102 to the controller 101. Information on a temperature difference between the central portion and the end portions with respect to the longitudinal direction of the fixing device 40 and drive (rotation) information are sent to the controller 100 from each of a central thermistor information acquiring portion 103, a D-side thermistor information acquiring portion 104, an AD-side thermistor information acquiring portion 105, and a motor information acquiring portion 106.

Then, as regards LIFE 1, inside the controller 100, a rotation distance acquiring portion 100*b* acquires a rotation distance. Further, the controller 100 acquires a third weighting coefficient and multiplies the rotation distance by this third weighting coefficient, and thus estimates a lifetime (device lifetime) LIFE 1 of the fixing device 40.

Figure 6:
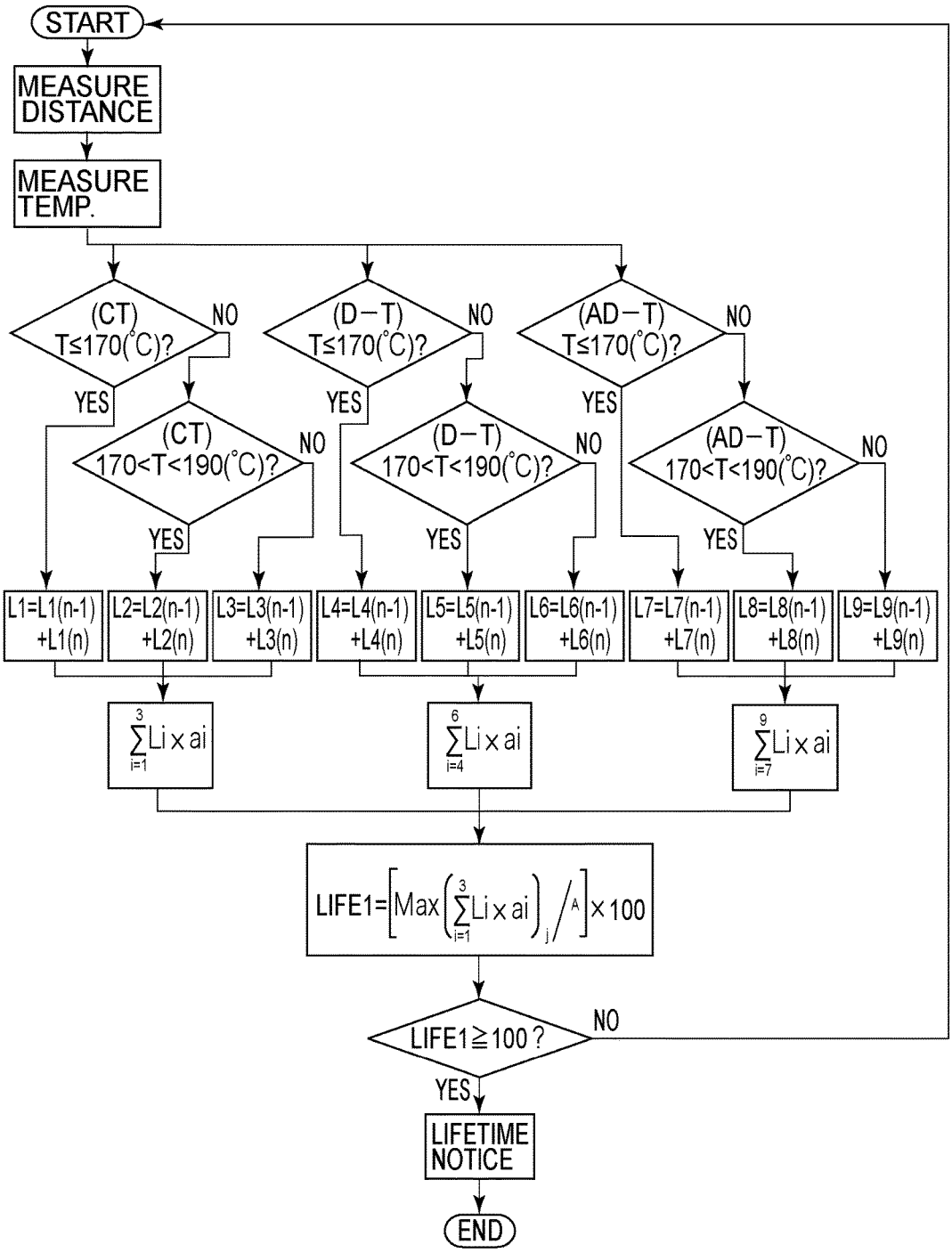
FIG. 6 is a flowchart showing a lifetime detecting sequence of the fixing device.

A control flow in this embodiment is shown in FIG. 6. First, the controller 100 receives a job of the image forming apparatus 1 and acquires a sheet size (with respect to a feeding direction) and a basis weight of the recording material (sheet) to be passed through the fixing device 40. Thereafter a driving motor is driven and the heater 43 is energized, and then temperatures of the central portion thermistor 45*b*1 and the end portion thermistors 45*b*2 and 45*b*3 at the back surface of the fixing film 41 are measured. Then, values of a sheet passing distance are stored at portions corresponding to temperature sections of the central portion thermistor 45*b*1 and the end portion thermistors 45*b*2 and 45*b*3. The sheet passing distance for every temperature zone is integrated and is multiplied by a temperature coefficient and a basis weight coefficient, so that a value of LIFE 1 is calculated. When the LIFE 1 value is 100% or more, lifetime advance notice of the fixing device 40 is displayed.

Effect of Lifetime Detection on the Basis of LIFE 1 Value

In a case in which generation of abrasion of a fixing film surface layer is discriminated by a sheet passing number counter as conventionally used, depending on a use status of a customer, an abrasion generation sheet number fluctuates to 60K sheets or 100K sheets. By employing the constitution in this embodiment, however, the fixing film surface layer abrasion generates on the image when the LIFE 1 value is 100%, and therefore, an exchange estimate was easily made. For example, in the case of a customer for whom the LIFE 1 value advances by 10% every month, when a current LIFE 1 value is 80%, exchange may only be required to be made after two months, so that a service person easily creates a plan of action.

Figure 8:
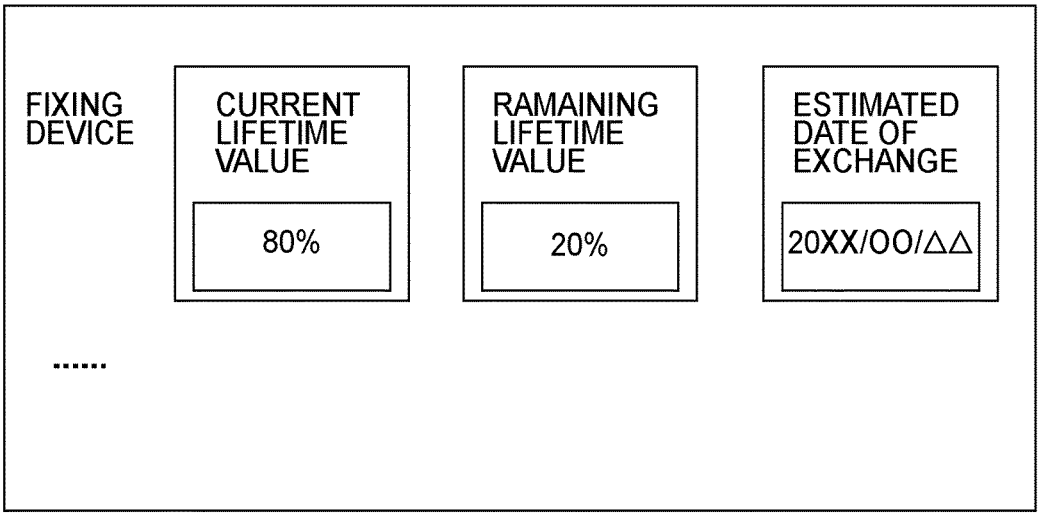
FIG. 8 is an illustration showing display of a lifetime of the fixing device.

Further, when the current LIFE 1 value is 80%, a remaining lifetime is displayed as 20%, so that a user can confirm an estimate of exchange. FIG. 8 shows an example of a display of the operating portion 101. At the operating portion 101 of the image forming apparatus 1, a current LIFE 1 value, a remaining LIFE 1 value, and an exchange estimated date (estimate day) of a consumable part (i.e., a fixing device 40) are outputted (displayed). By employing such a constitution in this embodiment, it is possible to make the lifetime detection of the fixing device 40 with accuracy, so that at proper timing, it is possible to prompt the user to exchange the fixing device 40 (i.e., to provide warning by a warning portion).

In this embodiment, in a case when a difference in lifetime of the fixing device 40 generates depending on a sheet passing mode and a sheet passing state, the sheet passing distance for which weighting depending on a difference in temperature zone between the central portion and the end portions and weighting in view of the basis weight of the sheet subjected to the sheet passing are performed is integrated. As a result, without using a particular detecting portion, the lifetime of the fixing device 40 is accurately estimated irrespective of the sheet passing mode and the sheet passing state, so that it is possible to prompt the user to exchange the fixing device 40 at a proper timing.

The estimation of the detected lifetime LIFE 1 from the viewpoint of the abrasion of the inner surface of the fixing film 41 was described above. It is also possible, however, to perform estimation of a fixing device lifetime LIFE 2 from a viewpoint of abrasion of the surface layer of the fixing film 41.

Estimation of Fixing Device Lifetime LIFE 2 from Viewpoint of Surface Layer Abrasion of Fixing Film As regards the surface layer abrasion of the fixing film 41, an abrasion amount changes depending on a temperature difference between the longitudinal central portion and the longitudinal end portions when the recording material passes through the nip N. Further, the abrasion amount changes depending on a length of the sheet subjected to the sheet passing (sheet passing distance), a thickness of the sheet subjected to the sheet passing (basis weight), and the temperature difference between the central portion and the end portions with respect to the longitudinal direction.

The reason why the surface layer abrasion amount of the fixing film 41 changes depending on the temperature difference between the longitudinal central portion and the longitudinal end portions is as follows. At the longitudinal end portions, the temperature increases due to the non-sheet passing portion temperature rise, and the fixing film 41 and the pressing roller 44 expand, so that diameters thereof become large. As a result, the fixing film 41 increases in speed relative to the recording material (sheet) P subjected to the sheet passing, so that a speed difference generates between the fixing film 41 and the recording material (sheet)

P. The surface layer abrasion on the basis of this speed difference increases with an increasing temperature difference.

On the other hand, when the temperature at the longitudinal end portions is less than the temperature at the longitudinal central portion, the fixing film 41 decreases in speed relative to the recording material (sheet) P subjected to the sheet passing, so that a speed difference generates between the fixing film 41 and the recording material (sheet) P. The surface layer abrasion on the basis of this speed difference increases with an increasing temperature difference.

The reason why the surface layer abrasion amount of the fixing film 41 changes depending on the basis weight of the sheet subjected to the sheet passing is that as described above, when the fixing film surface contactable to the recording material P contacts the pressing roller 44 at a high surface (bearing) pressure and the recording material P passes through the fixing film 41 and the pressing roller 44, a shearing force generating at an edge portion of the recording material P is not constant. This shearing force abrades the fixing film surface, but is greater particularly in the case of the recording material (sheet) P having a large thickness, and, therefore, even when printing of the same number of sheets P is effected, a degree of the abrasion of the fixing film 41 is large.

Here, the passing of the recording material through the nip N is detectable in the following manner. That is, as a passing detecting portion, a pre-fixing sensor 110 for detecting entering of the recording material P, and a post-fixing sensor 120 for detecting discharge of the recording material P from the nip N are used as shown in FIG. 1. The sheet passing may also be counted by making estimation that the recording material P passes through the nip N after a lapse of several seconds from feeding of the recording material P from the registration roller pair 23 shown in FIG. 1.

Then, the CPU 100 functions as an acquiring portion, including first and second acquiring portions, for acquiring a detected temperature of the first temperature detecting portion **45*b*1 and a detected temperature of the second temperature detecting portion 45*b*2 or 45*b*3, respectively, when the recording material P passes through the nip N. This acquiring portion includes a counting portion for counting, on the basis of the detected temperatures of the first and second temperature detecting portions 45*b*1 and 45*b*2 or 45*b*3**, at the time when the recording material P with a predetermined width passes through the nip N, every passing of the recording material P with the predetermined width through the nip N.

Then, in a case in which a predetermined value is counted by the counting portion, on the basis of the acquiring portion, a message to the effect that the fixing film 41 should be exchanged is notified, as described above.

In this embodiment, as described below, when a sum (cumulative value) obtained by multiplying the sheet passing distance of the fixing film 41 by a coefficient (weighting coefficient) exceeds a predetermined value, a discrimination that the fixing device 40 reaches an end of a lifetime (device lifetime) LIFE 2 is made, so that it becomes possible to provide a notification prompting exchange of the fixing film 41. In this embodiment, LIFE 1 is preferentially used, and, therefore, whether LIFE 2 should be used or not is selectable by the user.

(1) Sheet Passing Distance of Fixing Film and First and Second Weighting Coefficients In view of the above-described circumstances, in this embodiment, the sheet passing distance of the fixing film 41 is acquired for every temperature zone difference between the longitudinal central portion and the longitudinal end portions, and a temperature coefficient (first weighting coefficient) is set for every temperature zone difference between the longitudinal central portion and the longitudinal end portions. Further, a basis weight coefficient (second weighting coefficient) is set for every species (basis weight) of paper as the recording material (sheet) P. Then, when the sum of values obtained by multiplying the sheet passing distance of the fixing film 41 by the temperature coefficient and the basis weight coefficient exceeds a predetermined value, a discrimination that the fixing device 40 reaches an end of its lifetime, so that the notification prompting exchange of the fixing device 40 is made.

The sheet passing distance and the temperature (difference) coefficient (first weighting coefficient) in each of sections of the temperature difference zones (every temperature difference range) between the longitudinal central portion and one longitudinal end portion in this embodiment are shown in Table 2 below. Further, the sheet passing distance and the temperature (difference) coefficient (first weighting coefficient) in each of sections of the temperature difference zones (every temperature difference range) between the longitudinal central portion and the other longitudinal end portion in this embodiment are also shown in Table 2. Further, the basis weight coefficient (second weighting coefficient) is shown in Table 3 below.

In Table 3, the basis weight coefficient (second weighting coefficient) is represented by c1, c2, and c3 with 1.0, 2.0, and 3.0, respectively, on a right-hand side thereof as representative values. These representative values are used in a case in which fixed values are used in place of changing values c1, c2 and c3.

TABLE 2

| | CPT*1 (° C.) | | |
|---|---|---|---|
| | T ≤ 170 | 170 < T < 190 | 190 ≤ T |
| D-EPT*2 (° C.) | | | |
| 190 ≤ T | L13 | L16 | L19 |
| 170 < T < 190 | L12 | L15 | L18 |
| T ≤ 170 | L11 | L14 | L17 |
| 190 ≤ T | b13 | b16 | b19 |
| 170 < T < 190 | b12 | b15 | b18 |
| T ≤ 170 | b11 | b14 | b17 |
| AD-EPT*3 (° C.) | | | |
| 190 ≤ T | L23 | L26 | L29 |
| 170 < T < 190 | L22 | L25 | L28 |
| T ≤ 170 | L21 | L24 | L27 |
| D-EPT*3 (° C.) | | | |
| 190 ≤ T | b23 | b26 | b29 |
| 170 < T < 190 | b22 | b25 | b28 |
| T ≤ 170 | b21 | b24 | b27 |

*1"CPT" is the central portion temperature of the fixing film back surface.
*2"D-EPT" is a D (drive)-side end portion temperature of the fixing film back surface.
*3"AD-EPT" is an AD (anti-drive)-side end portion temperature of the fixing film back surface.

TABLE 3

| Basis weight (g/m$^2$) | Coefficient | |
|---|---|---|
| 52 ≤ and ≤ 105 | c1 | 1.0 |
| 105 < and ≤ 210 | c2 | 2.0 |
| 210 < and ≤ 300 | c3 | 3.0 |

As shown in the upper two portions of Table 2, the temperature difference section of the central portion of the fixing film back surface and a drive-side (D-side) end portion of the fixing film back surface is represented as a matrix of three (3) temperature sections of 170° C. or less, greater than 170° C. and less than 190° C., and 190° C. or more. In the left-hand side of Table 2, in the matrix consisting of nine (9) temperature sections at each of the central portion and one end portion (the drive-side end portion), acquired values (L13, and like) of the fixing film sheet passing distance and acquired values (b13, and the like) of the temperature coefficient (first weighting coefficient) are shown.

Similarly, in lower two portions of Table 2, the temperature difference section of the central portion of the fixing film back surface and an anti-drive-side (AD-side) end portion of the fixing film back surface is represented as a matrix of three (3) temperature sections of 170° C. or less, greater than 170° C. and less than 190° C., and 190° C. or more. In the right-hand side of Table 2, in the matrix consisting of nine (9) temperature sections at each of the central portion and the other end portion (the anti-drive-side end portion), acquired values (L12, and the like) of the fixing film sheet passing distance and acquired values (b12, and the like) of the temperature coefficient (first weighting coefficient) are shown.

There is no need to stick to the above-described nine temperature sections, so that the number of the temperature sections may also be increased or decreased. By increasing the number of the temperature sections, accuracy of the lifetime is improved. The number of calculating regions of the image forming apparatus 1 in this embodiment increases, and, therefore, there is a need to take measures, such as an increase in the number of memories of the image forming apparatus 1.

Further, each of the temperature sections of the drive-side thermistor and the temperature section of the anti-drive-side thermistor may be changed. For example, in a case in which mounting positions of the drive-side thermistor and the anti-drive-side thermistor are not bilaterally symmetrical, or in a case in which a sheet passing position of the paper is not a center position, the coefficients may also be changed.

The temperature sections were determined depending on the temperatures of the fixing film back surface, but may also be determined depending on temperatures of the heater back surface.

(2) Acquisition (Measurement) of Sheet Passing Distance of Fixing Film

Acquisition (measurement) of the sheet passing distance of the fixing film 41 is made on the basis of the size (with respect to the feeding direction) of the recording material (sheet), which is sent from the controller 100 and which is subjected to image formation. Specifically, a value obtained by multiplying the size of the recording material (sheet) with respect to the feeding direction by the number of sheets fed is acquired as the sum of addition of those with respect to different sizes (with respect to the feeding direction) of the recording materials.

(3) Temperature Measuring Timing and Temperature Coefficient (First Weighting Coefficient)

Temperature measuring timing for each of the thermistors is a time when a trailing end position of the recording material (sheet) P subjected to the sheet passing reaches a center of the nip N with respect to the recording material feeding direction. Then, each of measured thermistor temperatures is caused to correspond to an associated temperature zone, and a corresponding sheet passing distance value is stored. For example, in a case in which an A4 sized job is performed, when the central portion temperature is 170° C. and the D-side end portion temperature is 180° C. at the time when the trailing end position of A4-sized paper reaches the center of the nip N, an A4-sized paper length of 210 mm is stored as L12 in Table 1. A unit of L11 to L19 and L21 to L29 is mm.

Here, each temperature coefficient (first weighting coefficient) is defined on the basis of a fixing film sheet passing distance in which fixing film surface layer abrasion generates on the image when a sheet passing durability test is conducted in an operation in a certain mode (in this case, the weighting coefficient is 1). In this embodiment, each temperature coefficient is determined on the basis of a value obtained when the sheet passing durability test was conducted under a condition that each of temperatures of the central thermistor, the D-side thermistor, and the AD-side thermistor at the fixing film back surface is 170° C., the paper fed is plain paper, and the basis weight is 105 g/m$^2$.

A method of checking whether or not the fixing film surface layer abrasion generates on the image as follows. Every predetermined number of sheets, a blue solid image is formed on coated paper ("OK TOP", 128 (g/m$^2$), SRA3 size, manufactured Oji Paper Co., Ltd.). When offset is generated at an edge (end) portion of the paper (e.g., A4-sized paper) subjected to the sheet passing durability test, NG discrimination (generation of abrasion) is made.

When the sheet passing durability test is conducted for every temperature zone, the fixing film sheet passing distance in which the fixing film surface layer abrasion generates is as follows:

Central portion-end portion thermistor temperature difference: 0 (° C.) durability test . . . La (mm)

Central portion-end thermistor temperature difference: ±10 (° C.) durability test . . . Lb (mm)

Central portion-end portion thermistor temperature difference: ±20 (° C.) durability test . . . Lc (mm)

Here, the temperature coefficient (first weighting coefficient) is determined on the basis of the fixing film sheet passing distance when the temperature difference between the central portion thermistor and the end portion thermistor is 0(° C.), and, therefore, the coefficient when the durability test is conducted with the temperature difference of ±10 (° C.) is acquired (calculated) as La/Lb (when La>Lb is satisfied, the coefficient is greater than 1). Further, the coefficient when the durability test is conducted with the temperature difference of ±20 (° C.) is acquired (calculated) as La/Lc.

In this embodiment, the temperature coefficient (first weighting coefficient) was determined as an absolute value of the temperature difference, but may also be changed between a positive side and a negative side of the temperature difference depending on a fixing device constitution.

In this embodiment, the durability test for each temperature zone was conducted by passing A4-sized paper ("GF-C104", manufactured by Canon, Inc.) through the nip N while changing temperatures of the fixing film back surface at the central portion and the end portion. A discrimination of the generation of the fixing film surface layer abrasion is as follows. The fixing film sheet passing distance in which the fixing film surface layer abrasion generated was La=2.2×10$^7$ (mm), Lb=2.0×10$^7$ (mm) and Lc=1.8×10$^7$ (mm).

Therefore, the central-D-side thermistor temperature coefficients b11, b15 and b19 were 1.0, the coefficients b12, b14, b16, and b18 were 1.1, and the coefficients b13 and b17 were 1.2.

As regards the central-AD-side thermistor temperature coefficients (first weighting coefficients), their values were set at the same values as the central-D-side thermistor temperature coefficients (first weighting coefficients). Incidentally, when the temperature difference during the sheet passing is different for each of the central-D-side thermistor temperature coefficients and the central-AD-side thermistor temperature coefficients, the temperature coefficients (first weighting coefficients) may be changed. For example, in a case in which mounting positions of the D-side thermistor and the AD-side thermistor are not bilaterally symmetrical, or in a case in which the sheet passing position of the recording material (sheet) is not a center position, the temperature coefficients (first weighting coefficients) may also be changed.

(4) Basis Weight Coefficient (Second Weighting Coefficient)

A basis weight coefficient (second weighting coefficient) is determined on the basis of the fixing film sheet passing distance when the basis weight is 105 (g/m$^2$) (in this case, the weighting coefficient is 1). When the durability test was conducted while changing the basis weight of the recording materials (sheets), the sheet passing distance in which the fixing film surface layer abrasion generated was as follows. The durability test was conducted so that each of the central portion thermistor temperature and the end portion thermistor temperature was 170° C.

Basis weight=105 (g/m$^2$) or less: Ld (mm) (A4-sized paper ("GF-C104", manufactured by Canon, Inc.))

Basis weight=210 (g/m$^2$) or less: Le (mm) (A4-sized paper ("GF-C209", manufactured by Canon, Inc.))

Basis weight=300 (g/m$^2$) or less: Lf (mm) (A4-sized paper ("Color Copy A4 Mondi 300 t4", manufactured by Mondi))

The fixing film sheet passing distance in which the fixing film surface layer abrasion generated was Ld=$2.2\times10^7$ (mm), Le=$1.1\times10^7$ (mm), and Lf=$7.2\times10^6$ (mm).

The basis weight coefficient (second weighting coefficient) is based on the fixing film sheet passing distance when the basis weight is 105 g/m$^2$, and, therefore, the basis weight when the durability test is conducted with the basis weight of 210 g/m$^2$ or less is acquired (calculated) as Ld/Le (when Ld/Le, the coefficient is larger than 1). Similarly, the basis weight when the durability test is conducted with basis weight of 300 g/m$^2$, is acquired (calculated) as Ld/Lf.

There is no need to stick to three basis weight sections, so that the number of the basis weight sections may also be increased or decreased. By increasing the number of the basis weight sections, accuracy of the lifetime is improved. The number of calculating regions of the image forming apparatus 1 in this embodiment increases, however, and, therefore, there is a need to take measures such as an increase in the number of memories of the image forming apparatus 1.

In this embodiment, from the viewpoint of the fixing film surface layer abrasion, the fixing device lifetime LIFE 2 is defined by the following formula:

$$LIFE2 = \left[ \mathrm{Max}\left( \sum_{j,k=1}^{9,3} L_{ij} \times a_{ij} \times c_k \right)_i \Big/ B \right] \times 100$$

in which "i" indicates a thermistor section (two sections of central portion-D-side and central portion-AD-side), "j" indicates a temperature section (nine sections of 3×3 matrix including 170° C. or less, greater than 170° C. and less than 190° C., and 190° C. or more, k indicates a basis weight (paper thickness) coefficient (three sections of 52 g/m$^2$ or more and 105 g/m$^2$ or less, greater than 105 g/m$^2$ and 210 g/m$^2$ or less, and greater than 210 g/m$^2$ and 300 g/m$^2$ or less), and "B" indicates a normalization constant ($2.2\times10^7$ mm).

Thus, in this embodiment, the first acquiring portion for acquiring the pressing distance of the recording material P passing through the nip N is provided. Further, the second acquiring portion for acquiring recording material information on the temperature difference between the central portion and the end portion with respect to the longitudinal direction of the first fixing member heated by a heat source, or the heat source, and on the basis weight or the species of the recording material P is provided. Further, a third acquiring portion for acquiring the sum of values obtained by multiplying an output of values acquired by the first acquiring portion by the weighting coefficient depending on an associated output of the second acquiring portion is provided, and the device lifetime is estimated using an output of the third acquiring portion.

In a case in which the LIFE 2 value described above reaches 100%, the lifetime advance notice of the fixing device 40 is prompted. As the lifetime advance notice, display of a fixing device exchange message on a display of the image forming apparatus main assembly, or display of the fixing device exchange message in a personal computer (PC) side, where the PC is connected with the image forming apparatus 1 via a controller 100, is effective.

Incidentally, as regards the LIFE 2, the sheet passing distance is acquired, but a sheet passing time may also be acquired.

Control Flow

A block diagram in this embodiment regarding the LIFE 2 is the same as FIG. 5. Inside of the controller 100, the sheet passing distance acquiring portion 100*a* acquires the sheet passing distance.

Further, the controller 100 acquires the first and second weighting coefficients and multiplies the sheet passing distance by these first and second weighting coefficients, and thus, estimates a lifetime (device lifetime) LIFE 2 of the fixing device 40.

Figure 7:
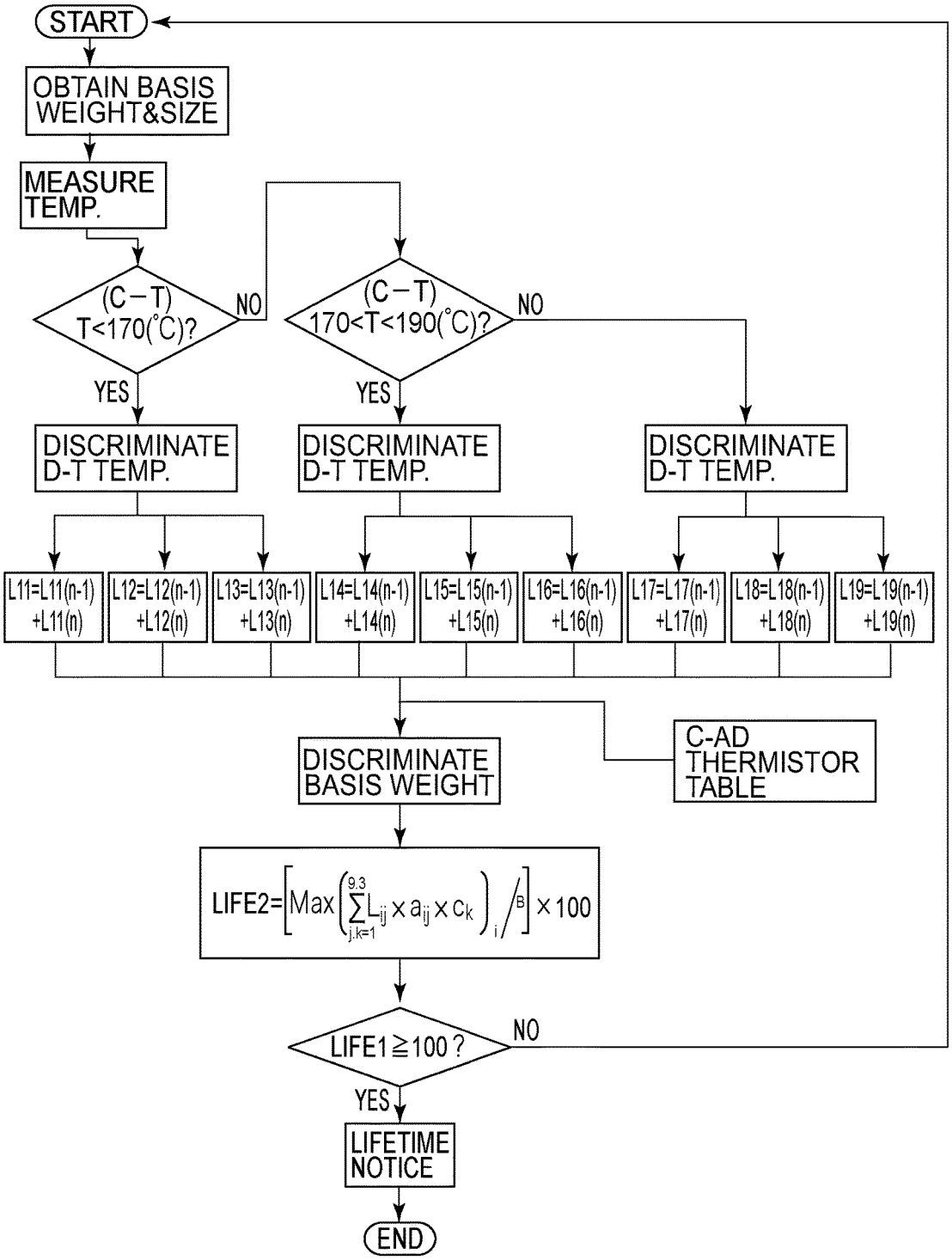
FIG. 7 is a flowchart showing a lifetime detecting sequence of another fixing device.

A control flow regarding the LIFE 2 in this embodiment is shown in FIG. 7. First, the controller 100 receives a job of the image forming apparatus 1 and acquires a sheet size (with respect to the feeding direction) and a basis weight of the recording material (sheet) P to be passed through the fixing device 40. Thereafter, a driving motor is driven and the heater 43 is energized, and then, temperatures of the central portion thermistor 45*b*1 and the end portion thermistors 45*b*2 and 45*b*3 at the back surface of the fixing film 41 are measured. Then, values of a sheet passing distance are stored at portions corresponding to temperature sections of the central portion thermistor 45*b*1 and the end portion thermistors 45*b*2 and 45*b*3. The sheet passing distance for every temperature zone is integrated and is multiplied by a temperature coefficient and a basis weight coefficient, so that a value of LIFE 2 is calculated. When the LIFE 2 value is 100% or more, lifetime advance notice of the fixing device 40 is displayed.

Thus, using the LIFE 2 value, the fixing device lifetime detection can be made with accuracy, so that it is possible to prompt the user to exchange the fixing device 40 (i.e., to provide warning by the warning portion) at a proper timing. Here, the device lifetime LIFE 1 and the device lifetime LIFE 2 are compared with each other as candidates for the device lifetime, and the candidate reaching a predetermined value early is determined as the device lifetime, and on the basis of the determined device lifetime, the fixing device exchange may also be prompted.

MODIFIED EMBODIMENTS

A first embodiment of the present invention was described above, but the present invention is not limited thereto. The present invention can be variously modified and changed within the scope thereof.

Modified Embodiment 1

In the above-described embodiment, the ceramic heater was used as the heating portion, but the present invention is not limited thereto. For example, a constitution in which the belt is directly heated by induced magnetic flux may be used.

Modified Embodiment 2

In the above-described embodiment, the acquiring portion acquired the rotation distance (traveling distance) of the fixing film 41, but the acquiring portion may also acquire a rotation time (traveling time). It is also possible to use a value obtained by multiplying the thus-acquired rotation time (traveling time) by the process speed as the rotation distance (traveling distance).

Modified Embodiment 3

The present invention can be similarly applied to fixing devices of a roller pair type and a belt pair type.

Modified Embodiment 4

In the above-described embodiment, recording paper was described as the recording material, but the recording material in the present invention is not limited to paper. In general, the recording material is a sheet-like member on which the toner image is to be formed and includes, e.g., regular or irregular materials of plain paper, thick paper, thin paper, an envelope, a postal card, a seal, a resin sheet, an overhead projector (OHP) sheet, and glossy paper. In the above-described embodiment, for convenience, the recording material (sheet) P was described using terms such as the sheet passing, the sheet discharge, the sheet feeding, the sheet passing portion, the non-sheet passing portion, but the recording material in the present invention is not limited to the sheet (paper).

Modified Embodiment 5

In the above-described embodiment, the fixing device for fixing the unfixed toner image on the sheet (recording material) was described as an example, but the present invention is not limited thereto. The present invention is similarly applicable to also a device for heating and pressing a toner image temporarily fixed on the sheet (recording material) in order to improve a glossiness of the image (also in this case, the device is referred to as the image heating device).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

(A) an image forming portion configured to form a toner image on a recording material;

(B) a fixing portion including:

(a) a first rotatable member;

(b) a second rotatable member, the first rotatable member and the second rotatable member being configured to form a nip therebetween for fixing the toner image, formed by the image forming portion, to the recording material and (c) a detecting portion configured to detect a temperature of the first rotatable member;

(C) an acquiring portion configured to acquire a rotation time of the first rotatable member; and (D) a notifying portion configured to provide a notification prompting exchange of the first rotatable member on the basis of an accumulated value of the rotation time of the first rotatable member acquired by the acquiring portion, the rotation time being subjected to weighting on the basis of the temperature of the first rotatable member detected by the detecting portion.

2. The image forming apparatus according to claim 1, wherein the detecting portion detects the temperature of the first rotatable member at a longitudinal central portion of the first rotatable member, and wherein the notifying portion provides the notification prompting exchange of the first rotatable member on the basis of an accumulated value of the rotation time of the first rotatable member acquired by the acquiring portion, the rotation time being subjected to weighting on the basis of the temperature of the first rotatable member at the longitudinal central portion acquired by the detecting portion.

3. An image forming apparatus comprising:

(A) an image forming portion configured to form a toner image on a recording material;

(B) a fixing portion including:

(a) a first rotatable member;

(b) a second rotatable member, the first rotatable member and the second rotatable member being configured to form a nip therebetween for fixing the toner image, formed by the image forming portion, to the recording material; and (c) a detecting portion configured to detect a temperature of the first rotatable member;

(C) an acquiring portion configured to acquire a length of the recording material to be passed through the fixing portion; and (D) a notifying portion configured to provide a notification prompting exchange of the first rotatable member on the basis of an accumulated value of the length of the recording material acquired by the acquiring portion, the length of the recording material being subjected to weighting on the basis of the temperature of the first rotatable member detected by the detecting portion.

4. The image forming apparatus according to claim 3, wherein the detecting portion detects the temperature of the first rotatable member at a longitudinal central portion of the first rotatable member, and at one longitudinal end portion of the first rotatable member, and wherein the notifying portion provides the notification prompting exchange of the first rotatable member on the basis of the accumulated value of the length of the recording material acquired by the acquiring portion, the length of the recording material being subjected to weighting on the basis of a difference between the temperature of the first rotatable member at the longitudinal central portion and the temperature of the first rotatable member at the longitudinal end portion that are detected by the detecting portion.

5. The image forming apparatus according to claim 3, further comprising (E) a second acquiring portion configured to acquire a basis weight of the recording material to be passed through the fixing portion, wherein the notifying portion provides the notification prompting exchange of the first rotatable member on the basis of the accumulated value of the length of the recording material acquired by the acquiring portion, the length of the recording material being subjected to weighting on the basis of the temperature of the first rotatable member at the longitudinal central portion detected by the detecting portion, and the basis weight of the recording material acquired by the second acquiring portion.

6. An image forming apparatus comprising:

(A) an image forming portion configured to form a toner image on a recording material;

(B) a fixing portion including:

(a) a first rotatable member;

(b) a second rotatable member, the first rotatable member and the second rotatable member being configured to form a nip therebetween for fixing the toner image, formed by the image forming portion, to the recording material; and (c) a detecting portion configured to detect a temperature of the first rotatable member;

(C) a first acquiring portion configured to acquire a rotation time of the first rotatable member;

(D) a first accumulating portion configured to accumulate the rotation time of the first rotatable member acquired by the first acquiring portion after the rotation time is weighted on the basis of the temperature of the first rotatable member detected by the detecting portion;

(E) a second acquiring portion configured to acquire a length of the recording material with respect to a feeding direction of the recording material;

(F) a second accumulating portion configured to accumulate the length of the recording material acquired by the second acquiring portion after the length of the recording material is weighted on the basis of the temperature of the first rotatable member detected by the detecting portion; and (G) a notifying portion configured to provide a notification prompting exchange of the first rotatable member on the basis of outputs of the first accumulating portion and the second accumulating portion.

* * * * *